US011795017B2

(12) United States Patent
Nishiyama et al.

(10) Patent No.: US 11,795,017 B2
(45) Date of Patent: Oct. 24, 2023

(54) SHEET FEEDING APPARATUS AND IMAGE FORMING APPARATUS

(71) Applicant: CANON KABUSHIKI KAISHA, Tokyo (JP)

(72) Inventors: Tatsuo Nishiyama, Kanagawa (JP); Tomoya Tateishi, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 18 days.

(21) Appl. No.: 17/718,488

(22) Filed: Apr. 12, 2022

(65) Prior Publication Data

US 2022/0332530 A1 Oct. 20, 2022

(30) Foreign Application Priority Data

Apr. 20, 2021 (JP) ..... 2021-071278

(51) Int. Cl.
*B65H 3/68* (2006.01)
*B65H 1/04* (2006.01)
*B65H 3/06* (2006.01)

(52) U.S. Cl.
CPC ..... *B65H 3/68* (2013.01); *B65H 1/04* (2013.01); *B65H 3/0684* (2013.01); *B65H 2405/324* (2013.01); *B65H 2407/21* (2013.01); *B65H 2801/06* (2013.01)

(58) Field of Classification Search
CPC ..... B65H 1/04; B65H 3/06; B65H 3/0661; B65H 3/5261; B65H 3/66; B65H 3/68; B65H 2402/31; B65H 2407/21; B65H 2404/74; B65H 2404/741; B65H 2404/7414; B65H 2404/743; B65H 2405/324
See application file for complete search history.

(56) References Cited

U.S. PATENT DOCUMENTS

| | | | | |
|---|---|---|---|---|
| 9,944,479 | B2 * | 4/2018 | Nakagawa | B65H 1/04 |
| 2016/0159591 | A1 * | 6/2016 | Takase | B65H 3/34 271/121 |
| 2018/0118479 | A1 * | 5/2018 | Ishii | B65H 3/047 |
| 2020/0062520 | A1 * | 2/2020 | Shindou | B65H 3/68 |

FOREIGN PATENT DOCUMENTS

| | | | |
|---|---|---|---|
| JP | H10245141 | A | 9/1998 |
| JP | 2017178620 | A | 10/2017 |

* cited by examiner

*Primary Examiner* — Prasad V Gokhale

(74) *Attorney, Agent, or Firm* — ROSSI, KIMMS & McDOWELL LLP

(57) ABSTRACT

A sheet feeding apparatus includes an apparatus body including an abutting portion, an opening/closing member, a stacking member, a feeding member, a conveyance unit including a separation portion, and a guide configured to guide a leading edge of the sheet conveyed by the feeding member from the stacking member toward the separation portion. The guide includes a supported portion supported pivotably by the apparatus body and an abutted portion configured to be abutted against the abutting portion. The guide is configured to move in interrelation with an operation of closing the opening/closing member and to be positioned inside the apparatus body with respect to the opening/closing member in the closed state of the opening/closing member. In the opened state of the opening/closing member, the guide is configured to be restricted from pivoting by the abutted portion being abutted against the abutting portion.

12 Claims, 7 Drawing Sheets

SHEET FEEDING APPARATUS AND IMAGE FORMING APPARATUS

BACKGROUND OF THE INVENTION

Field of the Invention

The present invention relates to a sheet feeding apparatus for feeding sheets, and an image forming apparatus for forming images on sheets.

Description of the Related Art

Image forming apparatuses such as printers, copying machines, and multifunction devices are equipped with a sheet feeding apparatus for feeding sheets serving as a recording material. Some sheet feeding apparatuses also referred to as manual sheet feeding members or multipurpose feeding members are designed to support sheets on a sheet feed tray provided on an exterior cover that can be opened and closed with respect to an apparatus body of the image forming apparatus.

This type of sheet feeding apparatus includes a pickup roller for sending out sheets from a sheet feed tray, and a separation roller pair for separating and conveying the sheets sent out by the pickup roller. Further, a guide, also referred to as a nip guide, that guides a leading edge of the sheet sent out by the pickup roller toward a nip portion of the separation roller pair is known. Japanese Patent Application Laid-Open Publication No. 2017-178620 discloses a sheet feeding apparatus equipped with a tray unit that includes a sheet stacking panel and that can be opened and closed with respect to an apparatus body, and a guide including a guide surface that guides the sheet to a nip portion of a separation roller pair.

According to the configuration disclosed in the above-described document, in a state where the tray unit is closed, the guide surface of the guide is positioned upstream of the separation roller pair with respect to a sheet conveyance direction at a nip portion of the separation roller pair, and the tray unit is positioned further upstream of the guide. However, since the guide disclosed in the above-described document is a member fixed to a frame body of the apparatus body, the tray unit is required to be arranged so that the tray unit in the closed state does not interfere with the guide. As a result, greater width in a horizontal direction was required to arrange the guide and the tray unit when the nip portion of the separation roller pair is viewed in a sheet width direction with the tray unit closed, which was one of the causes that lead to increase in size of the sheet feeding apparatus and the image forming apparatus.

SUMMARY OF THE INVENTION

The present technique provides a sheet feeding apparatus and an image forming apparatus that can be downsized.

According to one aspect of the invention, an image forming apparatus includes an apparatus body including an abutting portion, an opening/closing member supported pivotably by the apparatus body and configured to pivot between a closed state and an opened state, the opening/closing member in the closed state being positioned in a posture along a side face of the apparatus body, the opening/closing member in the opened state protruding outside the apparatus body with respect to the side face, a stacking member provided on the opening/closing member and configured to support a sheet thereon in the opened state of the opening/closing member, a feeding member configured to rotate around a rotational axis extending in a first direction and feed the sheet stacked on the stacking member, a conveyance unit including a separation portion and configured to convey a sheet fed by the feeding member while separating the sheet one by one in the separation portion, and a guide configured to guide a leading edge of the sheet conveyed by the feeding member from the stacking member toward the separation portion, the guide including a supported portion supported pivotably by the apparatus body and an abutted portion configured to be abutted against the abutting portion, the guide being configured to move in interrelation with an operation of closing the opening/closing member and to be positioned inside the apparatus body with respect to the opening/closing member in the closed state of the opening/closing member, wherein (i) in the opened state of the opening/closing member, an upstream end of the guide in a second direction is positioned at a first position, the second direction being a horizontal direction directed from outside to inside of the apparatus body with respect to the side face when viewed in the first direction, (ii) in the closed state of the opening/closing member, an upstream end of the guide in the second direction is positioned at a second position, and (iii) the second position is located downstream of the first position in the second direction, and wherein in the opened state of the opening/closing member, the guide is configured to be restricted from pivoting by the abutted portion being abutted against the abutting portion.

Further features of the present invention will become apparent from the following description of exemplary embodiments with reference to the attached drawings.

DESCRIPTION OF THE EMBODIMENTS

An embodiment of the present disclosure will be described below with reference to the drawings.

Figure 1:
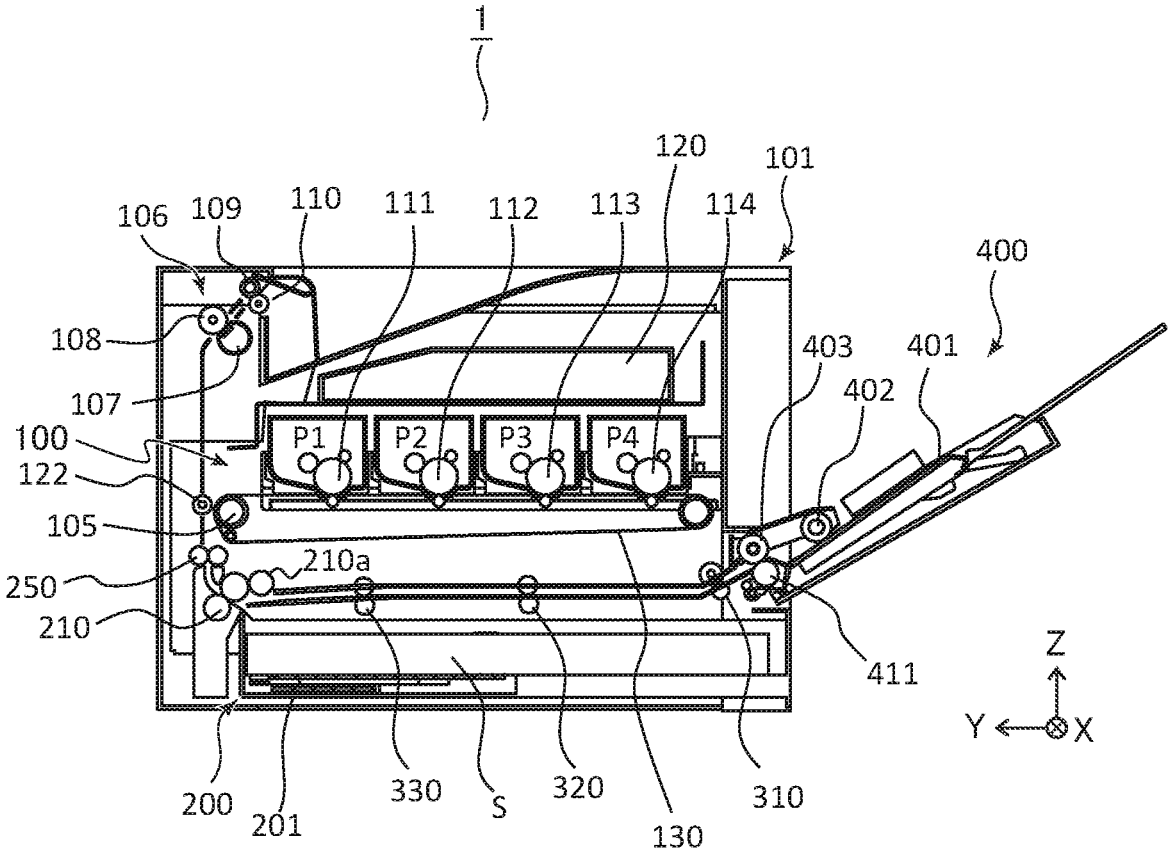
FIG. 1 is a schematic drawing of an image forming apparatus according to an embodiment.

FIG. 1 is a schematic drawing illustrating an image forming apparatus 1 according to the present embodiment. The image forming apparatus 1 described as an example in the present embodiment is a color laser beam printer that forms a color image on a sheet S by an electrophotographic process using four color toners. Sheet materials of various sizes and materials can be used as the sheet S serving as a recording material, including paper such as normal paper and thick paper, plastic films, cloths, sheet materials subjected to surface treatments such as coated paper, and special-shaped sheet materials such as envelopes and index paper.

In the following embodiments and drawings, a vertical direction of a state in which the image forming apparatus 1 is installed on a horizontal plane is referred to as a Z direction. A rotational axis direction of photosensitive drums 111, 112, 113, and 114 provided on the image forming apparatus 1 is referred to as an X direction or first direction. A horizontal direction when viewed in the X direction, that is, a direction perpendicularly intersecting the Z direction, is referred to as a Y direction or second direction. The X direction is a main scanning direction during forming of image, and it is also a sheet width direction perpendicularly intersecting the sheet conveyance direction in an interior of the image forming apparatus. The sheet width direction perpendicularly intersects a thickness direction of the sheet. The Y direction is a direction along a horizontal direction when viewed in the X direction, or sheet width direction, from outside to inside of (from an outer side toward an inner side of) an apparatus body 101 with respect to a side face 101R (FIGS. 3A and 3B) of the image forming apparatus on which a manual sheet feeding device 400 described below is provided. The X direction, the Y direction and the Z direction are mutually intersecting directions, which are preferably mutually orthogonal. Further, the shapes and arrangements of components that can be attached to and detached from the image forming apparatus are described using the X direction, the Y direction and the Z direction based on a position and arrangement of the components in a state attached to the image forming apparatus.

The image forming apparatus 1 includes the manual sheet feeding device 400, a cassette sheet feeding unit 200, an image forming unit 100, a fixing unit 106, and a sheet discharge tray 116. The cassette sheet feeding unit 200 is provided at a lower part in the apparatus body 101 of the image forming apparatus 1. The cassette sheet feeding unit 200 includes a cassette 201 that accommodates the sheets S in a stacked state and that can be detachably attached to the apparatus body 101. The cassette sheet feeding unit 200 includes a pickup roller 210*a* that sends out the sheets S stacked in the cassette 201, and a conveyance roller pair 210 that separates and conveys each sheet S sent out by the pickup roller 210*a*. A registration roller pair 250 is arranged downstream of the conveyance roller pair 210 in the sheet conveyance direction.

The manual sheet feeding device 400 includes a sheet feed tray 401 on which the sheet S is supported, and a feeding unit 405 for feeding sheets S one by one from the sheet feed tray 401. The details of the manual sheet feeding device 400 are described below. The manual sheet feeding device 400 and the registration roller pair 250 are connected by a conveyance path that extends approximately in the Y direction between an image forming unit 100 and the cassette 201 in an up-down direction. A plurality of conveyance roller pairs 310, 320, and 330 are arranged on the conveyance path.

The image forming unit 100 includes four process units P1, P2, P3, and P4 respectively including the photosensitive drums 111, 112, 113, and 114 serving as an image bearing member, or electrophotographic photosensitive member, and an intermediate transfer belt 130 serving as an intermediate transfer body. Each process unit P1 to P4 is a process unit that executes respective steps of the electrophotographic process, and includes a charging unit, a developing unit, and a cleaning device arranged in the circumference of the photosensitive drums 111 to 114. Further, a laser scanner 120 serving as a process unit, or exposure unit, is arranged above the process units P1 to P4. The intermediate transfer belt 130 is stretched across a transfer inner roller 105 and a stretching roller approximately in the Y direction. Primary transfer rollers opposing the respective photosensitive drums 111 to 114 with the intermediate transfer belt 130 interposed therebetween are arranged on an inner side of the intermediate transfer belt 130.

A secondary transfer roller 122 serving as a transfer unit for transferring an image onto a sheet S is arranged at a position opposing the transfer inner roller 105 with the intermediate transfer belt 130 interposed therebetween. A transfer portion, i.e., secondary transfer portion, at which transfer of image is performed is formed as a nip portion between the secondary transfer roller 122 and the intermediate transfer belt 130.

The fixing unit 106 is arranged downstream of the secondary transfer portion in the sheet conveyance direction. The fixing unit 106 includes a fixing film 108, a pressure roller 107, and a heating unit such as a ceramic heater for heating the fixing film 108. A fixing nip portion is formed between the pressure roller 107 and the heating unit opposing the pressure roller 107 with the fixing film 108 interposed therebetween. A sheet discharge roller pair composed of a sheet discharge roller 109 and a delivery roller 110 are arranged downstream of the fixing unit 106 in the sheet conveyance direction. Further, the sheet discharge tray 116 on which is supported the sheet S having an image formed thereon is provided on an upper surface portion of the apparatus body 101.

Image Forming Operation

When a controller of the image forming apparatus 1 receives a command to execute image formation from an external computer, the sheets S are fed one by one from the manual sheet feeding device 400 or the cassette sheet feeding unit 200 and conveyed to the registration roller pair 250. The sheet S fed from the manual sheet feeding device 400 is conveyed via the plurality of conveyance roller pairs 310, 320, and 330 and the conveyance roller pair 210 that is used in common with the cassette sheet feeding unit 200 to the registration roller pair 250. After correcting skewing of the sheet S, the registration roller pair 250 conveys the sheet S to the secondary transfer portion at a timing in synchronization with the formation of a toner image at the image forming unit 100.

In parallel with the feeding of the sheet S, a toner image is formed at the image forming unit 100. That is, the photosensitive drums 111 to 114 of the respective process units P1 to P4 are rotated, and the surface of the photosensitive drums 111 to 114 is charged uniformly by the charging unit. The laser scanner 120 exposes the photosensitive drums 111 to 114 by irradiating laser light thereon based on an image information received from an external computer and writes an electrostatic latent image to the surface of the photosensitive drums 111 to 114. The developing unit develops the image using developer containing toner and visualizes the electrostatic latent image as a toner image. Thereby, colored toner images of yellow, magenta, cyan, and black are formed on the respective photosensitive drums 111 to 114.

The toner images formed on the respective photosensitive drums 111 to 114 are primarily transferred via a primary transfer roller to the intermediate transfer belt 130. By transferring the respective colored toner image to be superposed on one another, a full-color image is formed on the intermediate transfer belt 130. The image borne on the intermediate transfer belt 130 is conveyed to the secondary transfer portion by being conveyed on the intermediate transfer belt 130, and the image is transferred, i.e., secondarily transferred, to the sheet S at the secondary transfer portion.

The sheet S having passed through the secondary transfer portion has the image on the sheets S pressed when passing the fixing nip at the fixing unit and heated by the fixing film 108. Thereby, the image is formed on the sheet S. The sheet S having passed through the fixing unit is discharged from the apparatus body 101 by the sheet discharge roller pair and supported on the sheet discharge tray 116 as a product.

Manual Sheet Feeding Device

Figure 2A:
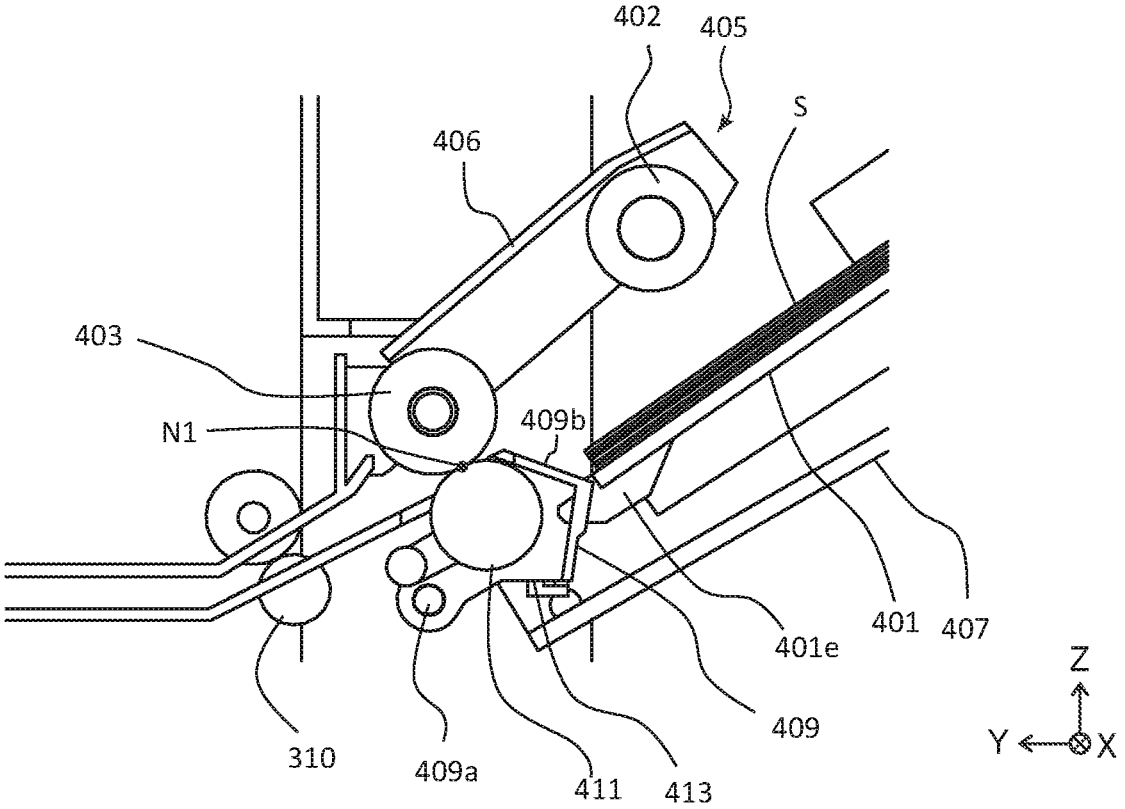
FIGS. 2A and 2B are each a cross-sectional view illustrating a part of a manual sheet feeding device according to the embodiment.
Figure 2B:
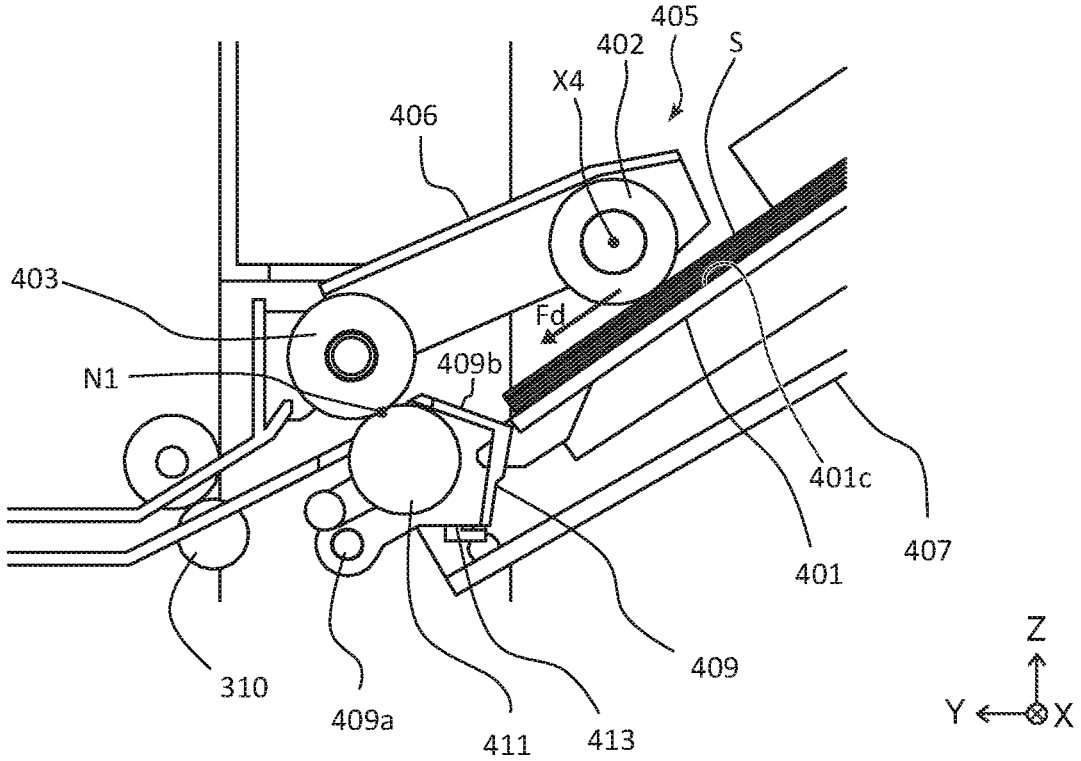

The configuration of the manual sheet feeding device 400 serving as a sheet feeding apparatus according to the present embodiment will be described with reference to FIGS. 2A and 2B. In the present embodiment, a feeding method of separating the sheets S by applying frictional force to the sheet from a separation roller 411 is adopted. FIGS. 2A and 2B each illustrate a cross-section of the feeding unit 405 (and an area surrounding thereof) of the manual sheet feeding device 400 cut at a plane perpendicular to the X direction, when viewed in the X direction.

As illustrated in FIGS. 2A and 2B, the manual sheet feeding device 400 includes the feeding unit 405 having a pickup roller 402, a feed roller 403 and the separation roller 411, an opening/closing member 407 on which the sheet feed tray 401 is provided, and a nip guide 409. The opening/closing member 407 will be described later with reference to FIGS. 3A and 3B. FIGS. 2A and 2B both illustrate the opening/closing member 407 in an opened state. The sheet feed tray 401 is a stacking member on which the sheet S is supported in a state where the opening/closing member is in the opened state. The sheet feed tray 401 is a plate-shaped member including a stacking surface 401*c* (refer also to FIG. 5C) on which the sheet S is supported.

The pickup roller 402 is a feeding member, i.e., sheet feeding roller, for feeding the sheet S supported on the stacking member. The pickup roller 402 is supported rotatably by a support member 406. The support member 406 is supported swingably in the up-down direction about the rotational axis of the feed roller 403 by the frame body of the apparatus body 101. By the swinging of the support member 406 in a state where the sheet feed tray 401 is fixed, the pickup roller 402 is abutted against and separated from the sheet S supported on the sheet feed tray 401. The apparatus body 101 of the image forming apparatus 1 refers to the part of the image forming apparatus 1 excluding the opening/closing member 407, the feeding unit 405, and the nip guide 409. In the present embodiment, the apparatus body of the manual sheet feeding device 400 refers to the apparatus body 101 common to the image forming apparatus 1.

The feed roller 403 and the separation roller 411 are a conveyance unit that conveys the sheets S while separating the sheet one by one in a separation nip N1 serving as a separation portion. The feed roller 403 serving as a conveyance roller is arranged downstream of the feed roller 403 in a sheet conveyance direction (left side in the drawing). The separation roller 411 is in pressure contact with the feed roller 403 by a predetermined pressurizing force. Thereby, the separation nip N1 is formed between the feed roller 403 and the separation roller 411. The pickup roller 402 and the feed roller 403 are driven to rotate in the clockwise direction in the drawing by driving force transmitted from a motor serving as a driving source arranged within the apparatus body 101. The separation roller 411 receives input of driving force, i.e., retard drive, in a direction opposing the conveyance direction of the sheet S at the separation nip N1, i.e., clockwise direction in the drawing, via a torque limiter.

The nip guide 409 is a guide that guides a leading edge of the sheet fed from the stacking member by the feeding member toward the separation portion. The nip guide 409 includes a guide surface, i.e., sheet passing surface, 409*b* that opposes the conveyance path of the sheet S from below in the area between the sheet feed tray 401 and the separation nip N1 in the Y direction. The guide surface 409*b* is inclined upward toward a downstream side with respect to a sheet feeding direction Fd to an extension line of an upper surface of the sheet feed tray 401, i.e., stacking surface on which the sheet S is placed. Further, the separation nip N1 is at a position separated upward from the extension line of the upper surface of the sheet feed tray 401. Accordingly, the nip guide 409 has a function to guide a leading edge, that is, downstream edge in the sheet feeding direction Fd, of the sheet S sent out from the sheet feed tray 401 by the pickup roller 402 toward the separation nip N1 by the guide surface 409*b*.

As illustrated in FIG. 2A, in a state where the feeding operation of the sheet S is not performed, i.e., non-sheet-feed state, the pickup roller 402 is maintained at a position, i.e., standby position or separation position, separated upward from the sheet S on the sheet feed tray 401 by the support member 406.

As illustrated in FIG. 2B, when the feeding operation of the sheet S is started, the pickup roller 402 is lowered by the swinging of the support member 406 and moves to a position, that is, feeding position or contact position, in contact with the upper surface of the uppermost sheet S of the sheets S supported on the sheet feed tray 401. By the pickup roller 402 rotating around a rotational axis X4 extending in a first direction in this state, the uppermost sheet S is fed from the sheet feed tray 401 to the sheet feeding direction Fd. The first direction is the same direction as, that is, parallel to, the X direction. The pickup roller 402 rotates in the clockwise direction in FIG. 2B. The sheet S having reached the separation nip N1 is further conveyed by the feed roller 403. In this state, if only one sheet S enters the separation nip N1, the separation roller 411 rotates in a counterclockwise direction in the drawing by being moved together with the feed roller 403 by the torque limiter slipping by the force received from the sheet S. If a plurality of sheets S enter the separation nip N1, the separation roller 411 rotates in the clockwise direction in the drawing by the driving force transmitted via the torque limiter. Thereby, the sheets S other than the uppermost sheet S in contact with the feed roller 403 is pushed back toward the upstream side in the sheet feeding direction Fd and stays on the upstream side of the separation nip N1. Thereby, one sheet S is fed from the separation nip N1.

The separation roller 411 that receives retard drive is an example of a separation member, and for example, a separation roller connected via a torque limiter to a shaft member fixed to the frame body of the apparatus body 101 can be used as the separation member. Further, a pad-shaped elastic member that is in pressure contact with the feed roller 403 by predetermined pressurizing force can be used as the separation member.

Sheet Feed Tray and Opening/Closing Member

Figure 3A:
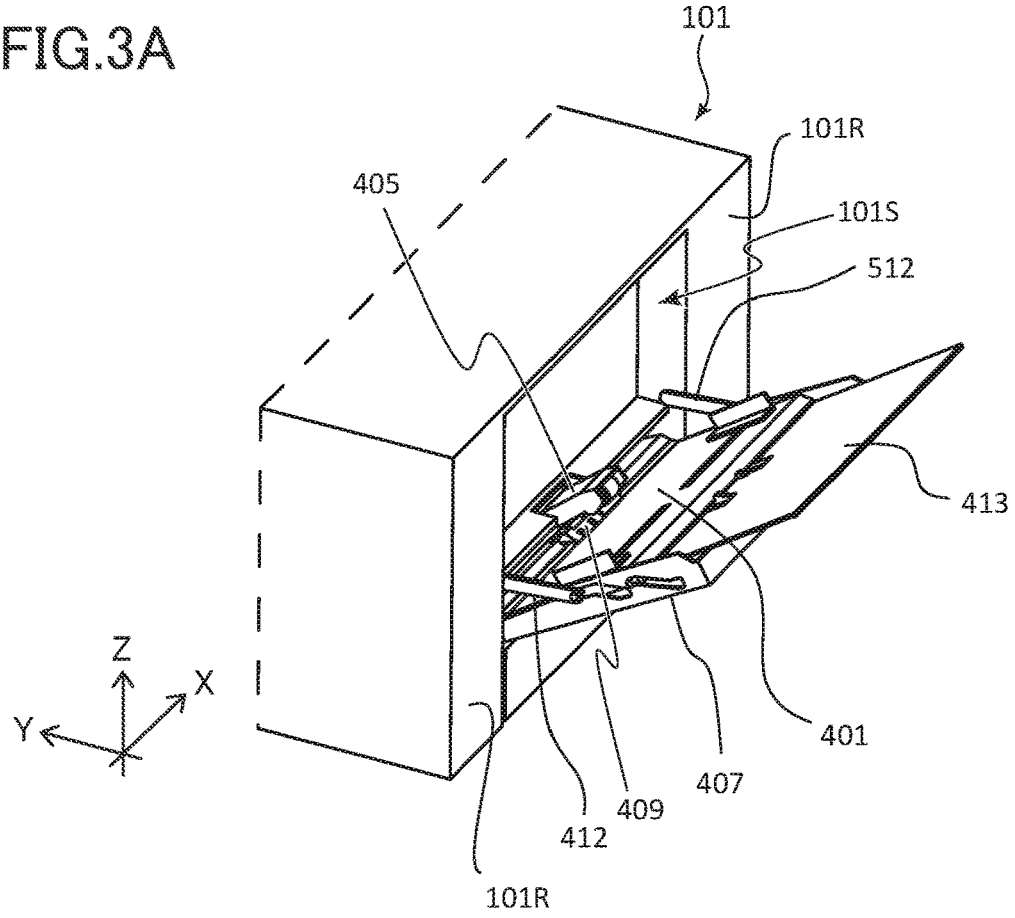
FIGS. 3A and 3B are each a perspective view illustrating a part of the image forming apparatus according to the present embodiment.
Figure 3B:
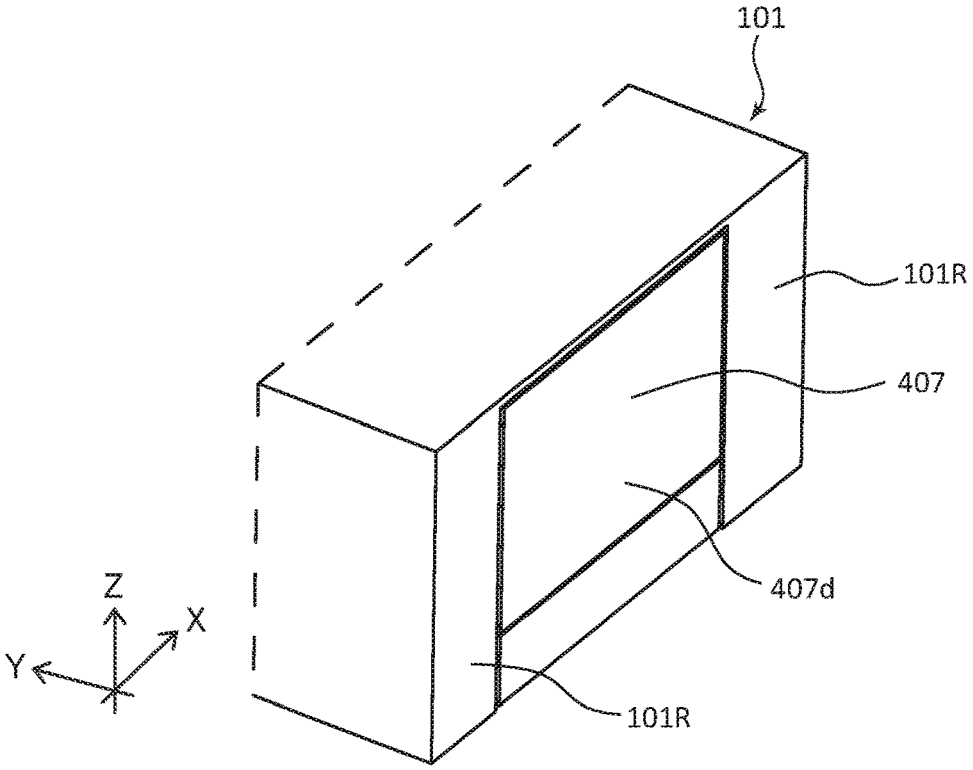
Figure 4A:
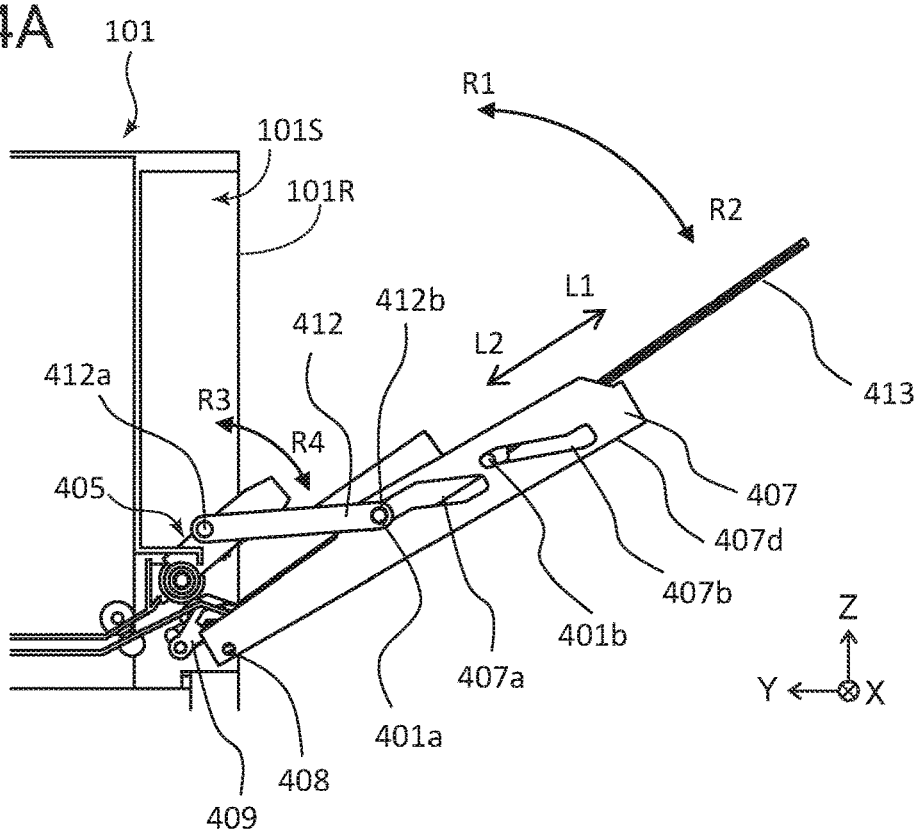
FIGS. 4A and 4B are each a cross-sectional view of the manual sheet feeding device according to the embodiment.
Figure 4B:
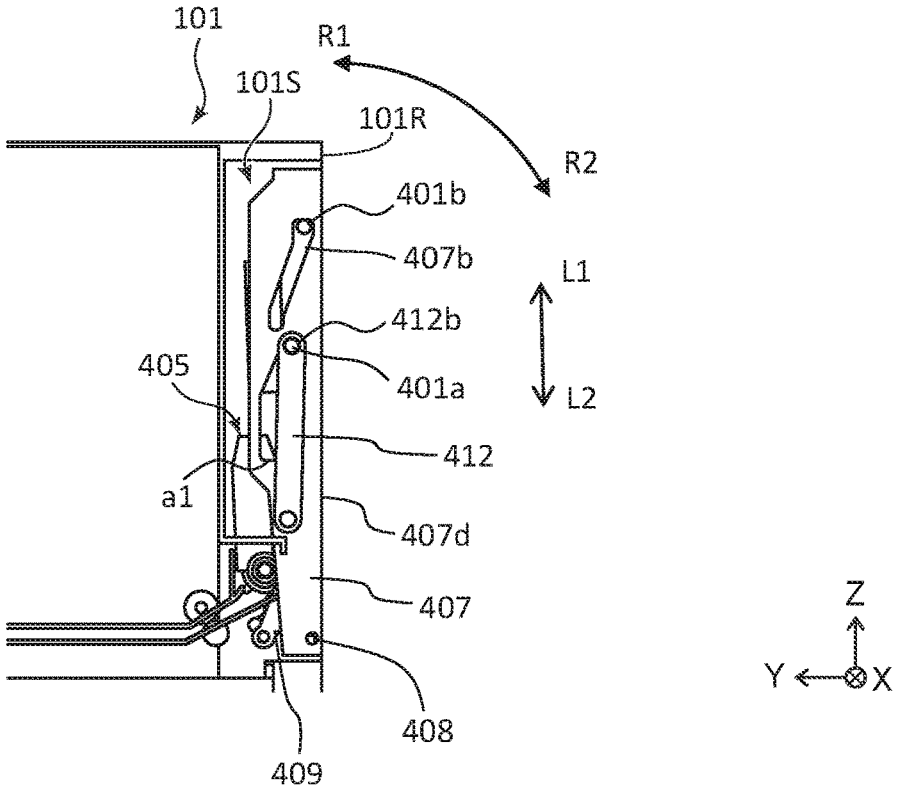

Next, the sheet feed tray 401 and the opening/closing member 407 will be described with reference to FIGS. 3A and 3B, FIGS. 4A and 4B, and FIG. 5C. FIG. 3A is a perspective view illustrating a portion of the image forming apparatus 1 with the opening/closing member 407 in the opened state, or first state, and FIG. 3B is a perspective view illustrating a portion of the image forming apparatus 1 with the opening/closing member 407 in the closed state, or second state. FIG. 4A illustrates a state in which a cross-section of the manual sheet feeding device 400 cut at a plane perpendicular to the X direction in a state where the opening/closing member 407 is opened is viewed in the X direction. FIG. 4B illustrates a state in which a cross-section of the manual sheet feeding device 400 cut at a plane perpendicular to the X direction in a state where the opening/closing member 407 is opened is viewed in the X direction. FIG. 5C is a perspective view of the sheet feed tray 401.

As illustrated in FIGS. 3A and 3B and FIGS. 4A and 4B, the opening/closing member 407 is supported pivotably, or openably/closably, by a support shaft 408 provided on the apparatus body, and pivots in an R1 direction, i.e., closing direction, and R2 direction, i.e., opening direction, which is the direction opposite thereto about the support shaft 408 serving as a fulcrum. In other words, the opening/closing member 407 is rotatable around a rotational axis X2 (refer also to FIGS. 6A to 6D). The rotational axis X2 extends in a direction parallel to the X direction. The opening/closing member 407 is positioned at a posture along the side face 101R of the apparatus body 101, that is, a posture in which an outer surface 407*d* of the opening/closing member 407 is extended approximately vertically in a view in the X direction, in the closed state illustrated in FIGS. 3B and 4B. The opening/closing member 407 constitutes a side surface upstream in the Y direction of the image forming apparatus 1 having an approximately rectangular parallelepiped shape together with the side face 101R of the apparatus body 101 in the closed state. That is, the opening/closing member 407 functions as an exterior cover of the image forming apparatus 1. In the closed state of the opening/closing member 407, the position of the sheet feed tray 401 is determined at a posture in which the stacking surface 401*c* (FIG. 5C) is approximately perpendicular.

An opening portion 101S is provided on the side face 101R upstream of the apparatus body 101 in the Y direction, forming a space that is opened toward the upstream side in the Y direction (FIGS. 3A and 4A). If the apparatus body 101 is viewed in the Y direction in a state where the opening/closing member 407 is closed, the opening portion 101S is covered by the opening/closing member 407 (FIGS. 3B and 4B). Further, in the closed state of the opening/closing member 407, members such as the nip guide 409, the feeding unit 405, the sheet feed tray 401, and arms 412 and 512 that constitute the manual sheet feeding device 400 are accommodated in the opening portion 101S. That is, in the closed state of the opening/closing member 407, members such as the nip guide 409 are positioned downstream of the opening/closing member 407 in the Y direction, that is, inside the apparatus body 101 with respect to the side face 101R. Therefore, if the width in the Y direction of the space occupied by the nip guide 409 and the like in the closed state of the opening/closing member 407 can be reduced, the position of the opening/closing member 407 in the closed state can be arranged further downstream in the Y direction to realize downsizing of the manual sheet feeding device 400 and the image forming apparatus 1 in the Y direction.

Further, the opening/closing member 407 protrudes to the outer side of the apparatus body 101, i.e., upstream side in the Y direction, from the side face 101R by being pivoted in the R2 direction toward the outer side of the apparatus body 101, i.e., upstream side in the Y direction, from the closed state. The opened state illustrated in FIGS. 3A and 4A is a state in which the opening/closing member 407 is positioned at a position pivoted for a predetermined angle from the closed state. That is, the opening/closing member 407 is a member, i.e., pivot member or door member, that pivots between a closed state positioned at a posture along the side face 101R of the apparatus body 101 and an opened state protruding to the outer side of the apparatus body 101 from the side face 101R. In the opened state, the user can place the sheet S on the sheet feed tray 401 from above the opening/closing member 407.

As illustrated in FIGS. 3A and 3B and FIGS. 4A and 4B, both end portions of the opening/closing member 407 in the X direction are connected to the apparatus body 101 via arms 412 and 512. As illustrated in FIG. 4A, the arm 412 pivots in an R3 direction and an R4 direction opposite thereto about an axis extending in the X direction by having a shaft 412*a* supported pivotably on the apparatus body 101. A shaft 401*a* is fit to a hole portion 412*b* provided on an end portion opposite to the shaft 412*a* of the arm 412, and the shaft 401*a* is fit to a groove 407*a* provided on an end portion in the X direction of the opening/closing member 407.

As illustrated in FIG. 5C, the shaft 401*a* is provided on one of the ends in the X direction of the sheet feed tray 401. Therefore, each set of the opening/closing member 407 and the arm 412, the sheet feed tray 401 and the arm 412, and the opening/closing member 407 and the sheet feed tray 401 are respectively connected in a relatively movable manner via the shaft 401*a*. That is, the opening/closing member 407 and the arm 412 are connected pivotably via the shaft 401*a* and are also connected slidably by the shaft 401*a* being fitted to the groove 407*a*. The sheet feed tray 401 and the arm 412 are connected pivotably via the shaft 401*a*. The opening/closing member 407 and the sheet feed tray 401 are slidably connected by the shaft 401*a* being fitted to the groove 407*a*.

Further, another shaft 401*b* is arranged at a position distant from the shaft 401*a* on the sheet feed tray 401. As illustrated in FIGS. 4A and 4B, the shaft 401*b* is slidably fit to a groove 407*b* provided on the opening/closing member 407. The grooves 407*a* and 407*b* extend in a direction in which the sheet feed tray 401 is moved close to and away from the nip guide 409 when viewed in the X direction. In other words, the groove 407*a* is extended in a direction intersecting a circumference around a rotational axis of the nip guide 409. Regarding the sliding direction of the sheet feed tray 401 along the grooves 407*a* and 407*b*, the direction separating from the nip guide 409 is referred to as an L1 direction and the direction approaching the nip guide 409 is referred to as an L2 direction. The nip guide 409 is arranged close to the separation nip N1. Therefore, it can also be defined that the L1 direction is a direction in which the sheet feed tray 401 moves away from the separation nip N1, and the L2 direction is a direction in which the sheet feed tray 401 moves close to the separation nip N1. Further, the nip guide 409 is positioned close to the support shaft 408 of the opening/closing member 407. Therefore, it can also be defined that the L1 direction is a direction in which the sheet feed tray 401 slides away from the support shaft 408 with respect to the opening/closing member 407 and the L2 direction is a direction in which the sheet feed tray 401 slides toward the support shaft 408 with respect to the opening/closing member 407.

It is preferable for the grooves 407*a* and 407*b* to be arranged substantially in parallel at a same distance as the distance between the shafts 401*a* and 401*b* of the sheet feed tray 401. In this case, as described later, in a state where the sheet feed tray 401 slides with respect to the opening/closing member 407 along with the opening and closing of the opening/closing member 407, the sheet feed tray 401 slides while maintaining an approximately fixed posture to the opening/closing member 407.

A shaft 401*g* and a shaft 401*h* are also provided on the other end portion in the X direction of the sheet feed tray 401. The shaft 401*g* fits to a hole portion not shown on an arm 512. A groove not shown that fits slidably to the shaft 401*g* is provided on the other end portion, that is, end portion on the depth side in FIG. 3A, of the opening/closing member 407. The shaft 401*h* fits to a groove not shown on the opening/closing member 407. The methods for connecting the arm 512, the opening/closing member 407 and the sheet feed tray 401 at the other end portion in the X direction including the shafts 401*g* and 401*h* and the arm 512 are similar to the first side in the X direction mentioned above, so that the detailed descriptions thereof are omitted.

A configuration example in which the shafts 401*a*, 401*b*, 401*g*, and 401*h* are provided on the sheet feed tray 401 has been described above, but other configurations can also be used. For example, a similar function as the present embodiment can be obtained by providing a shaft that fits slidably to the groove 407*a* of the opening/closing member 407 on the arms 412 and 512 and providing a hole on the sheet feed tray 401 that fits pivotably to the shaft on the sheet feed tray 401.

Opening Operation of Opening/Closing Member

The operations of the respective portions of the manual sheet feeding device 400 accompanying the opening and closing of the opening/closing member 407 will be described below. At first, an opening operation of moving the opening/closing member 407 from the closed state to the opened state will be described.

When using the manual sheet feeding device 400, the user holds the opening/closing member 407 in the closed state illustrated in FIGS. 3B and 4B and pivots the opening/closing member 407 in the R2 direction. Since the shaft 401*a* moves in the R2 direction along with the pivoting of the opening/closing member 407 in the R2 direction, the arm 412 pivots in the R4 direction. Further, along with the pivoting of the opening/closing member 407 in the R2 direction, the shaft 401*a* slides in the L2 direction within the groove 407*a*. Thereby, the sheet feed tray 401 slides in the L2 direction with respect to the opening/closing member 407. In other words, the sheet feed tray 401 slides in a direction approaching the support shaft 408 and the separation nip N1, i.e., L2 direction, in interrelation with the opening operation of the opening/closing member 407. Further, the other shaft 401*b* of the sheet feed tray 401 also slides in the L2 direction within the groove 407*b* by the sheet feed tray 401 sliding in the L2 direction.

As illustrated in FIG. 4A, when the opening/closing member 407 pivots to a predetermined angle, the shaft 401*a* abuts against an abutting portion al which is the end portion of the groove 407*a* (refer to FIG. 4B), by which the opening/closing member 407 is regulated from pivoting in the R2 direction beyond the predetermined angle. Thereby, the opening/closing member 407 is in an opened state of a determined position at a predetermined angle. Further, in a state where the shaft 401*a* is positioned by being abutted against the abutting portion al of the groove 407*a*, the movement of the sheet feed tray 401 in the L2 direction is regulated, and the sheet feed tray 401 is positioned with respect to the opening/closing member 407. As a result, the sheet feed tray 401 is maintained at a position pivoted to a predetermined angle that is approximately equal to the opening/closing member 407, and in that state, the user can place the sheets S on the stacking surface 401*c* from above.

Further, an extension tray 413 that is slidable in the L1 and L2 directions is provided on the opening/closing member 407. As illustrated in FIG. 4A, the extension tray 413 can be drawn out in the L1 direction in the opened state of the opening/closing member 407 to enable a longer sheet to be supported thereon than the opening/closing member 407 and the sheet feed tray 401.

Closing Operation of Opening/Closing Member

Next, a closing operation of moving the opening/closing member 407 from the opened state to the closed state will be described. In a state where the extension tray 413 is in a drawn-out position when closing the opening/closing member 407 in the opened state, the user slides the extension tray 413 to the L2 direction in advance. In this state, a stopper portion not shown provided on the extension tray 413 moves the extension tray 413 to a position where it is abutted against a stopper portion not shown provided on the sheet feed tray 401. Thereby, the extension tray 413 is accommodated in a space formed between the sheet feed tray 401 and the opening/closing member 407.

Next, the user holds and pivots the opening/closing member 407 in the R1 direction. The shaft 401*a* moves in the R1 direction along with the pivoting of the opening/closing member 407 in the R1 direction, by which the arm 412 pivots in the R3 direction. Further, in interrelation with the pivoting of the opening/closing member 407 in the R1 direction, the shaft 401*a* slides in the L1 direction within the groove 407*a*. Thereby, the sheet feed tray 401 slides in the L1 direction with respect to the opening/closing member 407. In other words, the sheet feed tray 401 slides in the direction separating from the support shaft 408 and the separation nip N1, i.e., L1 direction, in interrelation with the closing operation of the opening/closing member 407. Further, by the sliding of the sheet feed tray 401 in the L1 direction, the other shaft 401*b* of the sheet feed tray 401 also slides in the L1 direction within the groove 407*b*.

Nip Guide

Figure 5A:
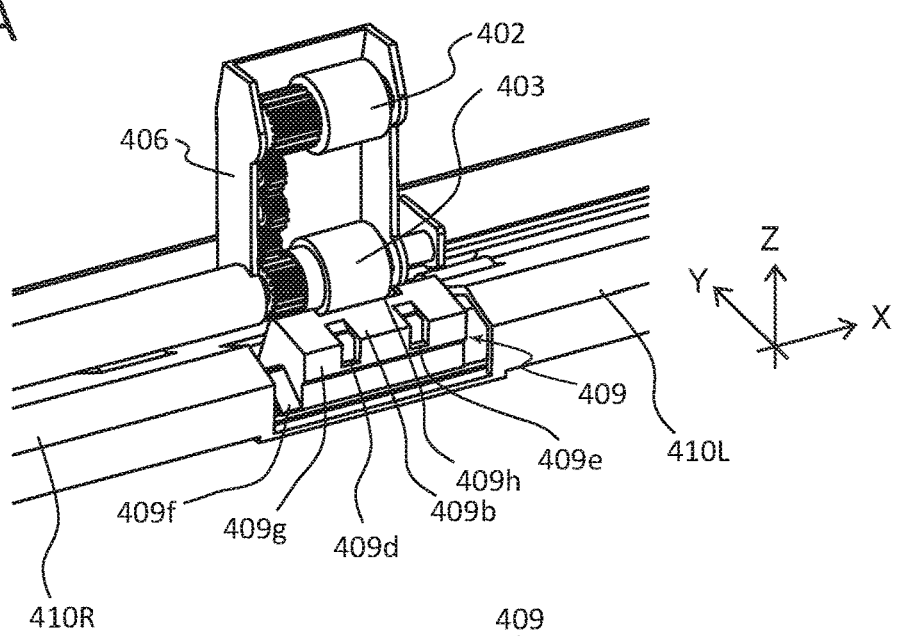
FIG. 5A is a perspective view illustrating a nip guide and a feeding unit and a surrounding area thereof in a state where an opening/closing member according to the embodiment is closed.
Figure 5B:
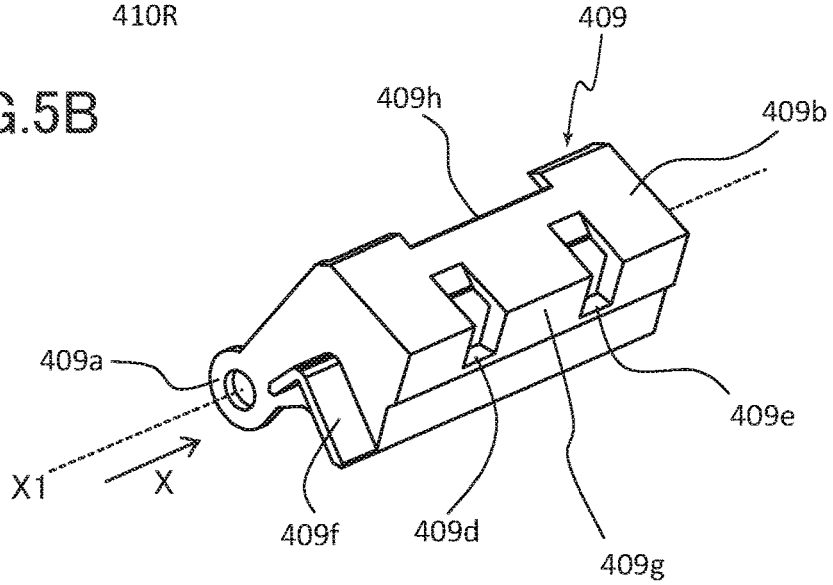
FIG. 5B is a perspective view of the nip guide according to the embodiment.
Figure 5C:
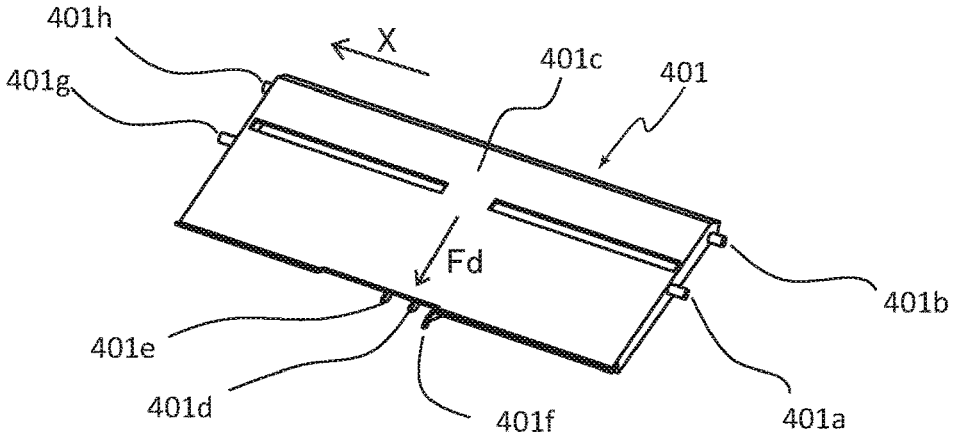
FIG. 5C is a perspective view of a sheet feed tray according to the embodiment.
Figure 6A:
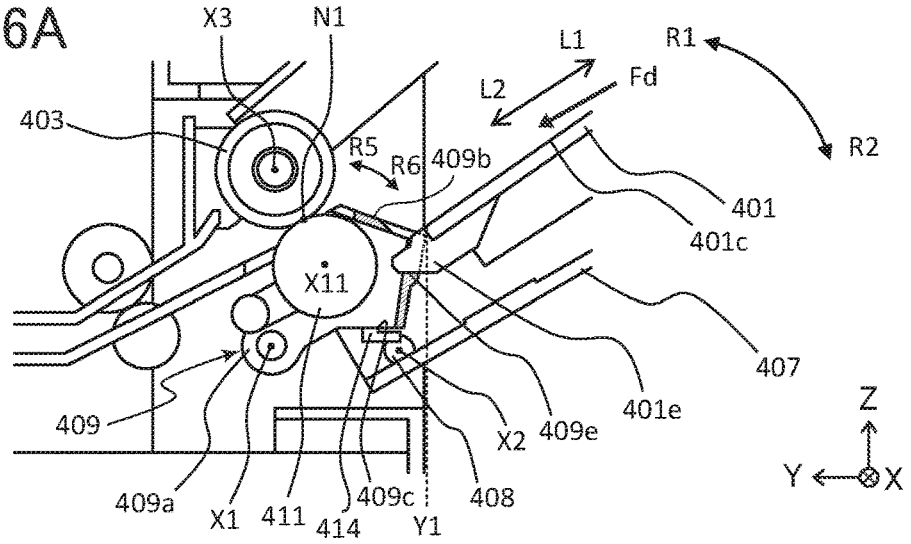
FIGS. 6A to 6D are each an explanatory view illustrating an operation of the nip guide according to the embodiment.
Figure 6B:
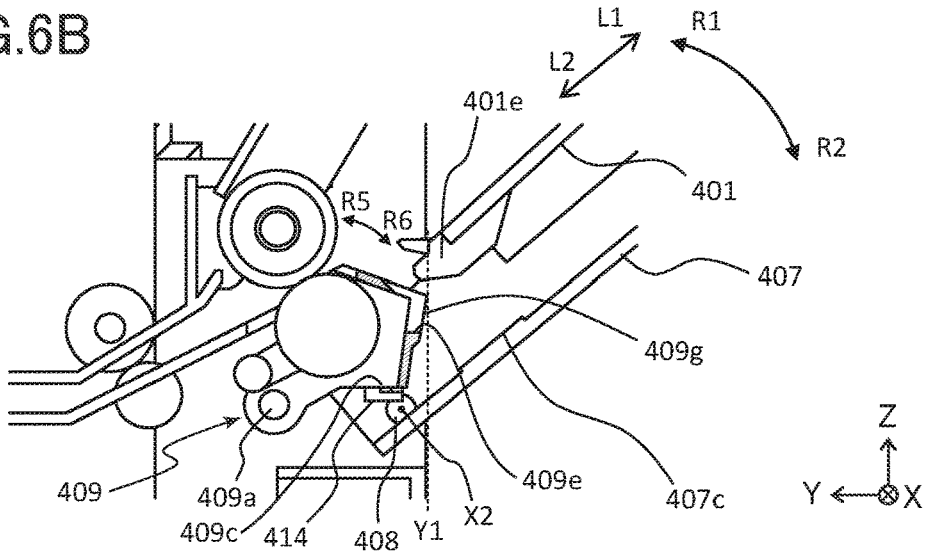
Figure 6C:
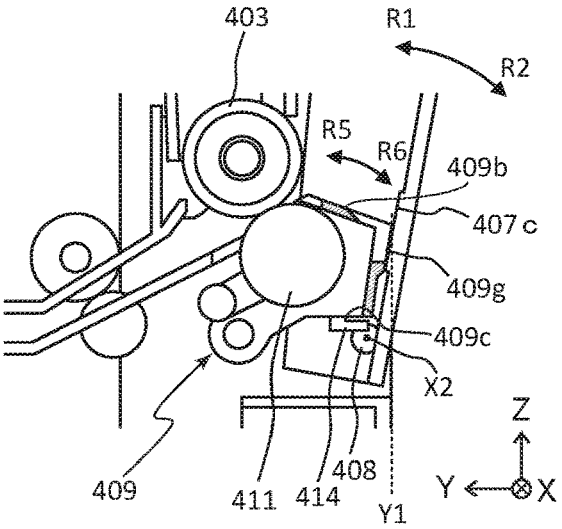
Figure 6D:
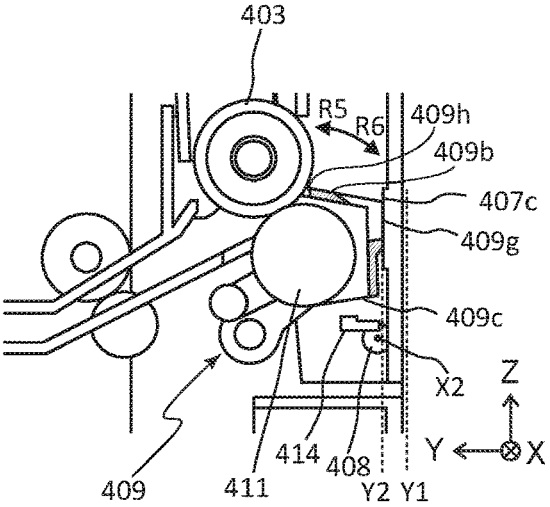

Next, with reference to FIGS. 5A to 5C and FIGS. 6A to 6D, the configuration and operation of the nip guide 409 are explained. FIG. 5A is a view illustrating the nip guide 409 in a state attached to the apparatus body 101 and illustrates a surrounding area of the nip guide 409 and the feeding unit 405 in the closed state of the opening/closing member 407. In FIG. 5A, the opening/closing member 407, the sheet feed tray 401, and the extension tray 413 are not shown. FIG. 5B is a perspective view of the nip guide 409 in a state detached from the apparatus body 101. FIGS. 6A to 6D all illustrate a cross-sectional view in which the surrounding area of the nip guide 409 is cut at a plane perpendicular to the X direction. FIGS. 6A to 6D illustrate a cross-sectional view at the X direction position in which an opening 409*e* of the nip guide 409 and a rib 401*e* of the sheet feed tray 401 described later are visible. Further, FIG. 6A illustrates an opened state of the opening/closing member 407, FIG. 6D illustrates a closed state of the opening/closing member 407, and FIGS. 6B and 6C illustrate a state between the opened state and the closed state.

As illustrated in FIGS. 5A and 5B, the nip guide 409 includes a pivot 409*a*, the guide surface 409*b*, an abutting surface 409*g*, openings 409*d* and 409*e*, a cutout 409*h*, and a guided portion 409*f* Further, as illustrated in FIG. 6A, the nip guide 409 includes an abutted portion 409*c* abutted against a rib 414 serving as an abutting portion of the apparatus body described later.

The guide surface 409*b* is a surface that guides a leading edge of the sheet S sent out from the sheet feed tray 401 by the pickup roller 402 toward the separation nip N1. When viewed from an upstream side in the sheet feeding direction Fd in the opened state of the opening/closing member 407 (FIG. 6A), the guide surface 409*b* is overlapped with an outer circumference of the separation roller 411. Preferably, a lower edge of the guide surface 409*b*, i.e., corner portion between the abutting surface 409*g* described below, when viewed from the upstream side of the sheet feeding direction Fd is positioned lower than a downstream edge of the stacking surface 401*c* of the sheet feed tray 401. Thereby, the possibility of the leading edge of the sheet S entering the gap between the nip guide 409 and the stacking surface 401*c* can be reduced. Further, when viewed from the upstream side in the sheet feeding direction Fd in the opened state of the opening/closing member 407, an upper edge of the guide surface 409*b* is extended to an area close to the separation nip N1. Further, the guide surface 409*b* is preferably extended across a range including the whole area of the outer circumference of the separation roller 411 in the X direction.

As illustrated in FIG. 5A, fixed guides 410L and 410R fixed to the apparatus body 101 are provided on both sides of the nip guide 409 in the X direction. The fixed guides 410L and 410R have a function to guide the side edge portions of the sheet S sent out from the sheet feed tray 401 by the pickup roller 402 at both sides of the separation nip N1 in the X direction. In the opened state of the opening/closing member 407, the guide surface 409*b* of the nip guide 409 is protruded upstream in the Y direction of the fixed guides 410L and 410R. Thereby, the center portion of the sheet S is guided more reliably to the separation nip N1 by the guide surface 409*b* of the nip guide 409.

The pivot 409*a* is a portion supported pivotably by the shaft member provided on the apparatus body 101. The pivot 409*a* functions as a supported portion in the nip guide 409 supported by the apparatus body 101. The pivot 409*a* is formed at a position separated from the opening/closing member 407 and the sheet feed tray 401. The pivot 409*a* is provided on both ends of the nip guide 409 in the X direction. The nip guide 409 pivots in an R5 direction and an R6 direction opposite thereto around a rotation axis X1 extending substantially in the X direction about the pivot 409*a*. The R5 direction is a direction in which the nip guide 409 pivots in interrelation with the closing direction of the opening/closing member 407, i.e., first direction, and the R6 direction is a direction in which the nip guide 409 pivots in interrelation with the opening operation of the opening/closing member 407, i.e., second direction.

The abutting surface 409*g* is a surface upstream of the nip guide 409 in the Y direction. The abutting surface 409*g* is a portion that is opposed to the opening/closing member 407 in the Y direction in the closed state of the opening/closing member 407 and that is abutted against an abutting surface 407*c* of the opening/closing member 407. The opening/closing member 407 has the abutting surface 407*c* on a side opposite from an outer surface 407*d*, i.e., on a surface downstream in the Y direction in the closed state. The abutting surface 407*c* abuts against the guide during the operation of closing the opening/closing member and functions as a first contact portion that moves the guide from a position of the guide in the opened state of the opening/closing member to a position of the guide in the closed state of the opening/closing member.

Openings 409*d* and 409*e* are formed from a portion on an upstream edge in the sheet feeding direction Fd of the guide surface 409*b* to a portion on an upstream edge of the abutting surface 409*g*. In the present embodiment, the openings 409*d* and 409*e* are holes formed on the nip guide 409, but the openings 409*d* and 409*e* can also be recess portions. That is, the openings 409*d* and 409*e* can be recesses that are formed from the upstream side toward the downstream side in the sheet feeding direction Fd. The openings 409*d* and 409*e* can be formed such that a portion on the upstream edge in the sheet feeding direction Fd of the guide surface 409*b* is recessed toward the downstream side. The openings 409*d* and 409*e* can be parts that are formed such that a portion on the upper edge of the abutting surface 409*g* is recessed toward the lower side.

As illustrated in FIG. 5C, ribs 401*d* and 401*e* that protrude toward the downstream side in the sheet feeding direction Fd are provided near the center portion in the X direction within the downstream edge in the sheet feeding direction Fd of the sheet feed tray 401. As illustrated in FIG. 6A, the ribs 401*d* and 401*e* are portions that enter the openings 409*d* and 409*e* of the nip guide 409 in the opened state of the opening/closing member 407 and press lower edge portions of the openings 409*d* and 409*e* from above. The ribs 401*d* and 401*e* function as second contact portions that contact the guide in the opened state of the opening/closing member 407 and urge the guide toward the abutting portion, i.e., the rib 414 of the apparatus body mentioned later. The openings 409*d* and 409*e* and the abutting surface 409*g* are provided at different positions.

Further, it is preferable that at least a portion of an upper edge of the ribs 401*d* and 401*e* is formed as a surface continuous to the stacking surface 401*c*. Further, when viewed in the X direction in the opened state of the opening/closing member 407 illustrated in FIG. 6A, it is preferable that an upper edge portion of the ribs 401*d* and 401*e* is intersecting with the guide surface 409*b* of the nip guide 409. Thereby, the possibility of the leading edge of the sheet S entering the gap between the nip guide 409 and the stacking surface 401*c* can be reduced.

As illustrated in FIGS. 5A and 5B, the cutout 409*h* has a recessed shape in which a portion of a downstream edge in the sheet feeding direction Fd of the guide surface 409*b* is recessed toward an upstream side in the sheet feeding direction Fd. The cutout 409*h* is formed at least across an area including the whole area of the outer circumference of the feed roller 403 with respect to the X direction. The cutout 409*h* forms a space that receives a portion of the feed roller 403 in the closed state of the opening/closing member 407, as mentioned below. In the closed state of the opening/closing member, the cutout 409*h* functions as a first recess portion, i.e., receiving portion, for receiving the conveyance roller. Further, the guide surface 409*b* extends between the openings 409*d* and 409*e* and the cutout 409*h* in the sheet feeding direction Fd, between the openings 409*d* and 409*e* in the X direction, and on both outer sides of the openings 409*d* and 409*e* and the cutout 409*h* in the X direction.

The guided portion 409*f* is a protruded portion that protrudes to the outer side in the X direction from the side of the nip guide 409 in the X direction. As illustrated in FIG. 5C, a guide rib 401*f* that protrudes toward the downstream side in the sheet feeding direction Fd is provided on the downstream edge in the sheet feeding direction Fd of the sheet feed tray 401. The guide rib 401*f* is provided on the position in the X direction corresponding to the guided portion 409*f* The guide rib 401*f* contacts the guide in the operation of opening the opening/closing member, and functions as a third contact portion that starts movement of the guide from the position of the guide in the closed state of the opening/closing member to the position of the guide in the opened state of the opening/closing member. The guided portion 409*f* of the nip guide 409 is a contacted portion that is in contact with the guide rib 401*f* for guiding the movement of the nip guide 409 when the opening operation of the opening/closing member 407 is performed.

Opened State of Opening/Closing Member

The position of the nip guide 409 in the opened state of the opening/closing member 407 will be described. In the opened state of the opening/closing member 407 illustrated in FIG. 6A, the nip guide 409 attempts to pivot in the R6 direction by its own weight. The apparatus body 101 is provided with a rib 414 that serves as an abutting portion, i.e., positioning portion or stopper, for positioning the nip guide 409. The rib 414 can be a fixed member that is fixed to the frame body of the apparatus body 101. The nip guide 409 is restricted from pivoting in the R6 direction by the abutted portion 409*c* provided on the lower portion of the nip guide 409 being abutted against the rib 414 to be positioned at the position illustrated in FIG. 6A. In the opened state of the opening/closing member 407, the rib 414 functions as an abutting portion for positioning the guide by abutting against the abutted portion 409*c* of the guide.

In the opened state of the opening/closing member 407, the ribs 401*d* and 401*e* which are projected portions on the sheet feed tray 401 enter the openings 409*d* and 409*e* on the nip guide 409 and presses the nip guide 409 downward. The nip guide 409 receives the own weight of the sheet feed tray 401, the weight of the sheets S supported on the sheet feed tray 401, and the pressurizing force when the pickup roller 402 contacts the sheet S through the ribs 401*d* and 401*e*. The nip guide 409 is more reliably positioned by the above-mentioned forces received from the sheet feed tray 401. Further, the sheet feed tray 401 that receives weight of the sheets S and the pressurizing force of the pickup roller 402 has the ribs 401*d* and 401*e* supported by the nip guide 409 in a state abutted against the rib 414 of the apparatus body 101. In other words, the sheet feed tray 401 serving as a stacking member has its second contact portion supported by the guide being abutted against the abutting portion in the opened state of the opening/closing member. Thereby, less deformation of the sheet feed tray 401 tends to occur. If less deformation of the sheet feed tray 401 tends to occur, there is less need to thicken the sheet feed tray 401 or to add reinforcing ribs to enhance stiffness, so that it is advantageous also from the viewpoint of downsizing the manual sheet feeding device 400 and the image forming apparatus 1. The numbers and arrangements of the openings 409*d* and 409*e* or the ribs 401*d* and 401*e* can be changed arbitrarily, but as an example, arranging the openings and ribs at multiple positions symmetric to the X directions from the center position of the separation nip N1 in the X direction is preferable from the viewpoint of suppressing deformation of the sheet feed tray 401.

During Closing Operation of Opening/Closing Member

Next, the operation of the nip guide 409 during closing operation of the opening/closing member 407 will be described. When the opening/closing member 407 illustrated in FIG. 6A is pivoted in the R1 direction from the opened state to close the opening/closing member 407, the sheet feed tray 401 slides in the L1 direction in interrelation with the opening/closing member 407 as described above. The L1 direction is a direction in which the sheet feed tray 401 moves away from the nip guide 409. Therefore, as illustrated in FIG. 6B, the ribs 401*d* and 401*e* of the sheet feed tray 401 withdraw, or separate, from the openings 409*d* and 409*e* of the nip guide 409. That is, the nip guide 409 is released from the pressing force applied from the ribs 401*d* and 401*e*, and the nip guide 409 is allowed to pivot in the R5 direction. That is, with the withdrawal of the projected portion of the stacking member from a second recess portion in interrelation with the operation of closing the opening/closing member, the guide is allowed to move from the position of the guide in the opened state of the opening/closing member to the position of the guide in the closed state of the opening/closing member.

When the opening/closing member 407 is pivoted further in the R1 direction, as illustrated in FIG. 6C, the abutting surface 407*c* of the opening/closing member 407 serving as a first contact portion abuts against the abutting surface 409*g* of the nip guide 409 and presses the nip guide 409. Thereby, the nip guide 409 pivots in the R5 direction. Further, as illustrated in FIG. 6D, the opening/closing member 407 reaches the closed state while the contact between the abutting surface 407*c* and the abutting surface 409*g* is maintained.

Now, when viewed in the X direction, an end position on an upstream side in the Y direction of the nip guide 409 in the opened state of the opening/closing member 407 is referred to as Y1 (FIG. 6A), and the end position on the upstream side in the Y direction of the nip guide 409 in the closed state of the opening/closing member 407 is referred to as Y2 (FIG. 6D). In other words, when viewed in the X direction, in the opened state of the opening/closing member 407, the end portion on the upstream side of the nip guide 409 in the Y direction is positioned at end position Y1, i.e., first position. Further, in the closed state of the opening/closing member 407, the end portion on the upstream side of the nip guide 409 in the Y direction is positioned at end position Y2, i.e., second position. In the present embodiment, the end position Y1 in the opened state is a position of a corner portion formed by the guide surface 409*b* and the abutting surface 409*g*, and the end position Y2 in the closed state is the position of the abutting surface 409*g* which is approximately perpendicular. As illustrated in FIGS. 6A and 6D, as a result of the nip guide 409 pivoting in interrelation with the closing operation of the opening/closing member 407, the end position Y2 of the nip guide 409 in the closed state is positioned downstream in the Y direction than the end position Y1 of the nip guide 409 in the opened state. That is, the end position Y2 is positioned downstream of the end position Y1 in the Y direction. In other words, the nip guide 409 moves so as to retreat to the inner side of the apparatus body 101 in interrelation with the closing operation of the opening/closing member 407.

In a comparative example in which the nip guide 409 is fixed to the apparatus body 101, the nip guide 409 will maintain the same position as the opened state of the opening/closing member 407 even if the opening/closing member 407 is closed. Therefore, the opening/closing member 407 is arranged at a position upstream in the Y direction compared to the present embodiment so that the opening/closing member 407 does not interfere with the nip guide 409 in the closed state.

Meanwhile, according to the present embodiment, the nip guide 409 moves in interrelation with the closing operation of the opening/closing member 407, such that the closing operation of the opening/closing member 407 can be completed without the opening/closing member 407 interfering with the nip guide 409 even if the position of the opening/closing member 407 is set downstream in the Y direction than the comparative example. Actually, the position of the opening/closing member 407 in the closed state can be set downstream in the Y direction than the comparative example for a distance corresponding to the distance between end positions Y1 and Y2 of the nip guide 409 in the opened state and the closed state. The distance between the end positions Y1 and Y2 of the nip guide 409 in the opened state and the closed state is a distance in which the nip guide 409 retreats toward the inner side of the apparatus body 101 in interrelation with the closing operation of the opening/closing member 407. Thereby, the Y-direction size of the manual sheet feeding device 400 in the closed state of the opening/closing member 407 can be downsized, and as a result, the Y-direction size of the image forming apparatus 1 can be downsized.

Further, in interrelation with the closing operation of the opening/closing member 407, the pickup roller 402 is pressed by the sheet feed tray 401, by which the support member 406 of the pickup roller 402 pivots in the R3 direction (FIGS. 3A and 3B). In the opened state of the opening/closing member 407, the support member 406 is projected upstream in the Y direction from the nip guide 409. With the support member 406 retreating downstream in the Y direction in interrelation with the closing operation of the opening/closing member 407, the closing operation of the opening/closing member 407 can be completed without the opening/closing member 407 interfering with the support member 406.

The movement of the nip guide 409 and a cutout 409*h* of the nip guide 409 in interrelation with the closing operation of the opening/closing member 407 will be described further. As illustrated in FIGS. 6A to 6D, the guide surface 409*b* of the nip guide 409 is at a position overlapped with the separation roller 411 when viewed from above in the opened state of the opening/closing member 407. Further, in a state where the nip guide 409 pivots in interrelation with the closing operation of the opening/closing member 407, the guide surface 409*b* pivots so as to be separated upward from the separation roller 411. Thus, according to the present embodiment, the nip guide 409 including the guide surface 409*b* for guiding the sheet S at the upstream side of the separation nip N1 separates the guide surface 409*b* from above the separation roller 411. Thereby, the nip guide 409 can be pivoted in interrelation with the closing operation of the opening/closing member 407 without interfering with the separation roller 411.

Further according to the present embodiment, the rotation axis X1 of the nip guide 409 is positioned downstream in the Y direction of the rotation axis X11 of the separation roller 411. Thereby, the guide surface 409*b* moves upward by the pivoting of the nip guide 409 in the R5 direction in interrelation with the closing operation of the opening/closing member 407. Further according to the present embodiment, the rotational axis X11 of the separation roller 411 is positioned upstream in the Y direction of a rotational axis X3 of the feed roller 403. When viewed from above, a portion upstream in the Y direction of an outer circumferential surface of the separation roller 411 is not covered by the feed roller 403. Therefore, the movement of the guide surface 409*b* of the nip guide 409 is enabled using the space above the upstream side portion in the Y direction of the separation roller 411.

When the nip guide 409 pivots in the R5 direction in interrelation with the closing operation of the opening/closing member 407, the guide surface 409*b* moves upward and toward the downstream side in the Y direction, such that the guide surface 409*b* approaches the feed roller 403. On the edge downstream in the Y direction of the guide surface 409*b* is provided the cutout 409*h* (FIG. 5B) mentioned above serving as the first recess portion. In the closed state of the opening/closing member 407, the nip guide 409 accommodates a part of the feed roller 403 on the inner side of the cutout 409*h* (FIG. 6D). That is, when the opening/closing member 407 is viewed in the X direction in the closed state, the outer circumference of the feed roller 403 and the guide surface 409*b* on both sides of the cutout 409*h* in the X direction are overlapped (FIG. 6D).

According to this configuration, compared to a case where the cutout 409*h* is not provided, the area in which the nip guide 409 can pivot in the R5 direction without interfering with the feed roller 403 is expanded. That is, the distance in which the nip guide 409 retreats toward the inner side of the apparatus body 101 in interrelation with the closing operation of the opening/closing member 407, that is, the distance between the end positions Y1 and Y2, can be increased. Thereby, the manual sheet feeding device 400 and the image forming apparatus 1 can be further downsized.

Further, the position of the nip guide 409 is not specifically limited, as long as the end position Y2 of the nip guide 409 in the closed state of the opening/closing member 407 is positioned downstream in the Y direction of the end position Y1 in the opened state of the opening/closing member 407. As an example, the end position Y2 of the nip guide 409 in the closed state of the opening/closing member 407 can be positioned approximately at the same position as the end position on the upstream side in the Y direction of the fixed guides 410L and 410R (FIG. 5A) arranged on both outer sides of the nip guide 409.

During Opening Operation of Opening/Closing Member

Next, the movement of the nip guide 409 during the opening operation of the opening/closing member 407 and the function of the guide rib 401*f* of the sheet feed tray 401 will be described. As described above, the nip guide 409 is provided to pivot in the R6 direction by its own weight. However, if the friction of the pivot 409*a* of the nip guide 409 is high or the image forming apparatus 1 is inclined, the nip guide may not pivot in the R6 direction by its own weight even if the opening/closing member 407 is opened.

Therefore, according to the present embodiment, a configuration is adopted in which the guide rib 401*f* (FIG. 5C) serving as a third contact portion provided on the sheet feed tray 401 presses the guided portion 409*f* (FIG. 5B) of the nip guide 409 in interrelation with the opening operation of the opening/closing member 407. Thereby, the nip guide 409 can be pivoted in the R6 direction more reliably in interrelation with the opening operation of the opening/closing member 407.

Figure 7A:
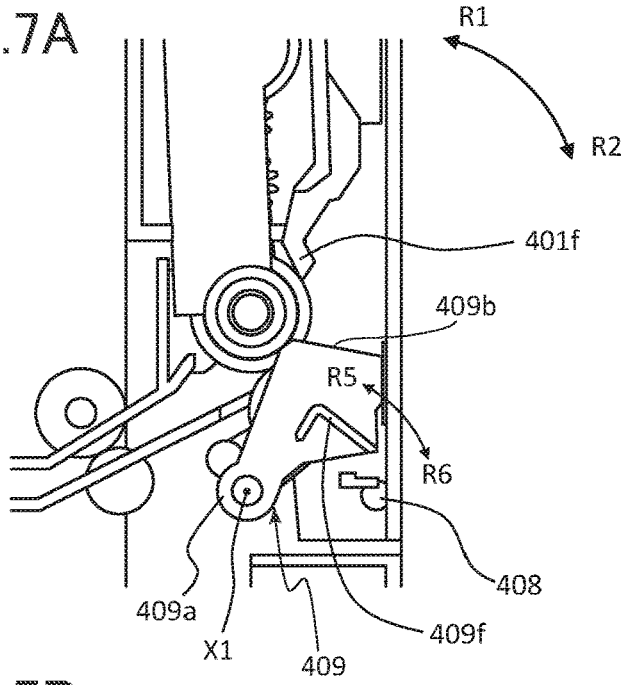
FIGS. 7A to 7C are each an explanatory view illustrating an operation of the nip guide according to the embodiment.
Figure 7B:
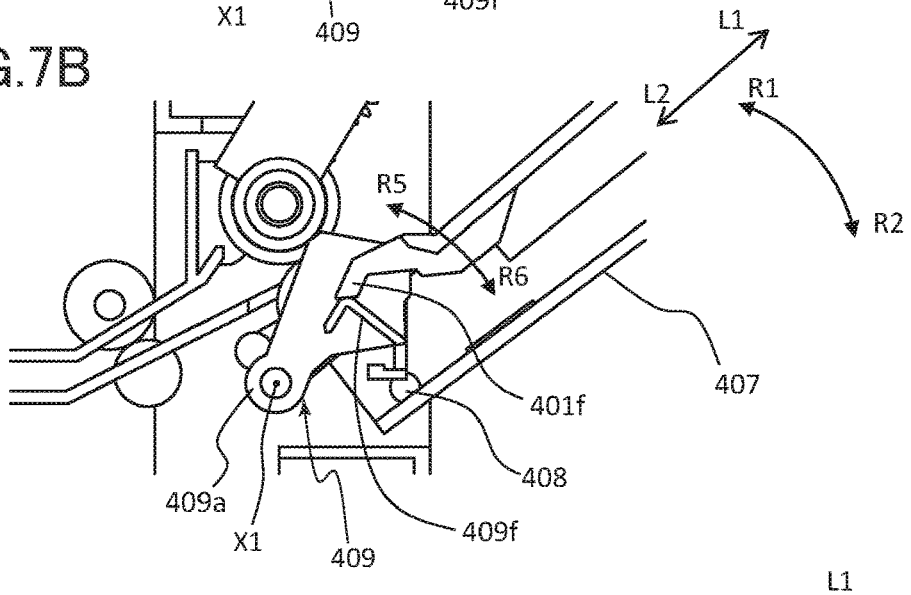
Figure 7C:
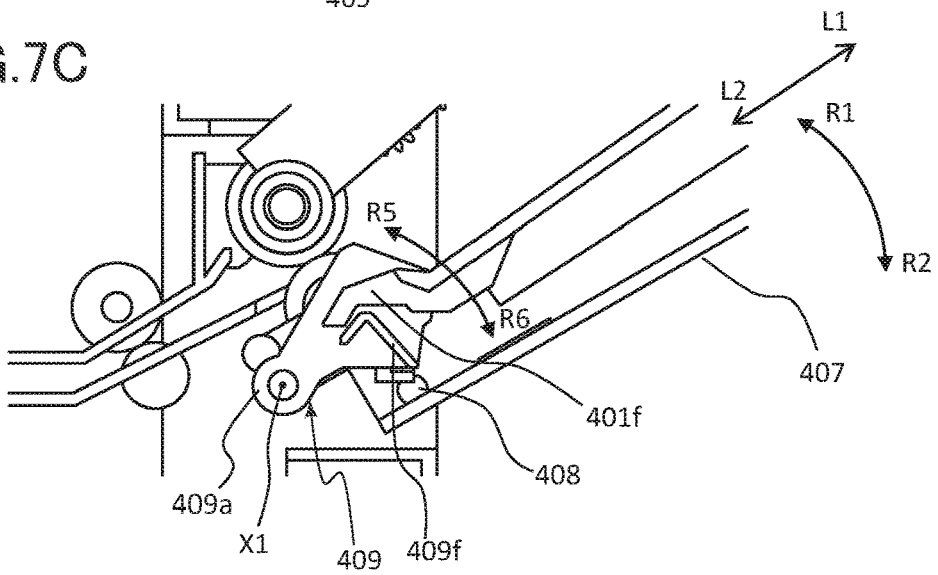

Hereafter, the detailed operation of the guide rib 401*f* will be described with reference to FIGS. 7A to 7C. FIGS. 7A to 7C are each an illustration of a state in which the surrounding area of the nip guide 409 is cut at a plane perpendicular to the X direction and viewed in the X direction. FIGS. 7A to 7C illustrate a cross-sectional view of the guided portion 409*f* of the nip guide 409 and the sheet feed tray 401 in the position passing the guide rib 401*f* in the X direction. FIG. 7A illustrates a closed state of the opening/closing member 407, FIG. 7C illustrates an opened state of the opening/closing member 407, and FIG. 7B illustrates a state between the opened state and the closed state.

In the closed state of the opening/closing member 407 illustrated in FIG. 7A, the sheet feed tray 401 is positioned at a position separated from the nip guide 409, that is, at a position on the L1-direction side. In this state, the guide rib 401*f* of the sheet feed tray 401 is separated from the guided portion 409*f* of the nip guide 409.

When the opening/closing member 407 is pivoted in the R2 direction to be opened as illustrated in FIG. 7B, the sheet feed tray 401 moves in the L2 direction in interrelation with the opening/closing member 407 and approaches the nip guide 409. Then, before the opening/closing member 407 reaches the opened state, the guide rib 401*f* is abutted against the guided portion 409*f*.

When the opening/closing member 407 is pivoted further in the R2 direction after the guide rib 401*f* abuts against the guided portion 409*f*, the guided portion 409*f* is pressed by the guide rib 401*f* and a rotating force in the R6 direction acts on the nip guide 409. Thereby, even if the pivoting in the R6 direction of the nip guide 409 by its own weight has not been started, the nip guide 409 pivots in the R6 direction by being pressed by the guide rib 401*f*.

At a point of time when the opening operation of the opening/closing member 407 is completed, as illustrated in FIG. 7C, the ribs 401*d* and 401*e* of the sheet feed tray 401 are in contact from above to the openings 409*d* and 409*e*, that is, the surface constituting the openings 409*d* and 409*e*, of the nip guide 409, as mentioned above (refer to FIG. 6A). Meanwhile, in the opened state of the opening/closing member 407, the guide rib 401*f* is not in contact with the guided portion 409*f* This is because it is advantageous for the ribs 401*d* and 401*e* provided at the center portion of the sheet feed tray 401 to be supported by the nip guide 409 in order to reduce deformation of the sheet feed tray 401 caused by the weight of the sheets S or the pressurizing force of the pickup roller 402 in the opened state of the opening/closing member 407.

As described, by providing the guide rib 401*f* of the sheet feed tray 401 and the guided portion 409*f* of the nip guide 409, the nip guide 409 can be pivoted more reliably during the opening operation of the opening/closing member 407.

Further according to the present embodiment, a configuration in which a portion of the sheet feed tray 401 is in contact with the nip guide 409 during the opening operation of the opening/closing member 407 has been described, but the nip guide 409 can also be pivoted by other methods during opening operation of the opening/closing member 407. For example, a spring member that urges the guide rib 401*f* in the R6 direction can be provided. Further, a configuration can be adopted in which a portion of the opening/closing member 407, that is, the portion other than the sheet feed tray 401, comes in contact with the nip guide 409 during the opening operation of the opening/closing member 407.

As described above, according to the configuration of the present embodiment, downsizing of the sheet feeding apparatus and the image forming apparatus can be realized.

Other Embodiments

According to the above-described embodiment, a configuration has been illustrated in which the nip guide 409 pivots in the R5 direction in interrelation with the closing operation of the opening/closing member 407 by a portion of the opening/closing member 407 coming in contact with the nip guide 409 during closing operation of the opening/closing member 407. The present disclosure is not limited to this configuration, and the nip guide 409 can be pivoted in the R5 direction by having other members in interrelation with the opening/closing member 407 come into contact with the nip guide 409, as long as the configuration enables the nip guide 409 to pivot in the R5 direction in interrelation with the closing operation of opening/closing member 407.

According further to the present embodiment, a configuration in which the sheet feed tray 401 slides with respect to the opening/closing member 407 in interrelation with the opening and closing of the opening/closing member 407 has been illustrated. The present technique is not limited thereto, and in a simpler configuration, a sheet feed tray can be provided as a portion of the opening/closing member 407, that is, as an upper surface of the plate-shaped opening/closing member 407 in the opened state.

Further, the nip guide 409 is an example of the guide, and the shape, dimension, and arrangement thereof can be changed arbitrarily.

Further according to the present embodiment, a color laser beam printer has been illustrated as an example of the image forming apparatus, but the present technique can be applied to an image forming apparatus equipped with image forming units other than the electrophotographic system, such as an ink-jet system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-071278 filed on Apr. 20, 2021, which is hereby incorporated by reference herein in its entirety.

What is claimed is:

1. A sheet feeding apparatus comprising:

an apparatus body including an abutting portion;

an opening/closing member supported pivotably by the apparatus body and configured to pivot between a closed state and an opened state, the opening/closing member in the closed state being positioned in a posture along a side face of the apparatus body, the opening/closing member in the opened state protruding outside the apparatus body with respect to the side face;

a stacking member provided on the opening/closing member and configured to support a sheet thereon in the opened state of the opening/closing member;

a feeding member configured to rotate around a rotational axis extending in a first direction and feed the sheet stacked on the stacking member;

a conveyance unit including a separation portion and configured to convey a sheet fed by the feeding member while separating the sheet one by one in the separation portion; and a guide configured to guide a leading edge of the sheet conveyed by the feeding member from the stacking member toward the separation portion, the guide including a supported portion supported pivotably by the apparatus body and an abutted portion configured to be abutted against the abutting portion, the guide being configured to move in interrelation with an operation of closing the opening/closing member and to be positioned inside the apparatus body with respect to the opening/closing member in the closed state of the opening/closing member, wherein (i) in the opened state of the opening/closing member, an upstream end of the guide in a second direction is positioned at a first position, the second direction being a horizontal direction directed from outside to inside of the apparatus body with respect to the side face when viewed in the first direction, (ii) in the closed state of the opening/closing member, an upstream end of the guide in the second direction is positioned at a second position, and (iii) the second position is located downstream of the first position in the second direction, and wherein in the opened state of the opening/closing member, the guide is configured to be restricted from pivoting by the abutted portion being abutted against the abutting portion.

2. The sheet feeding apparatus according to claim 1, wherein the conveyance unit includes a conveyance roller configured to convey the sheet and a separation roller configured to abut against the conveyance roller such that the separation portion is formed between the conveyance roller and the separation roller, wherein the guide includes a guide surface configured to guide the leading edge of the sheet fed from the stacking member by the feeding member toward the separation portion, wherein the guide surface overlaps a portion of the separation roller when viewed from above in the opened state of the opening/closing member, and wherein the guide surface is configured to move upward so as to separate from the separation roller while the guide is moved in interrelation with the operation of closing the opening/closing member.

3. The sheet feeding apparatus according to claim 2, wherein the guide further includes a receiving portion provided at a downstream end of the guide surface in the second direction and configured to receive the conveyance roller in the closed state of the opening/closing member.

4. The sheet feeding apparatus according to claim 2, wherein the supported portion is configured such that the guide pivots around an axis extending in the first direction, and wherein the axis is positioned downstream of a rotational axis of the separation roller in the second direction.

5. The sheet feeding apparatus according to claim 1, wherein the opening/closing member includes a first contact portion configured to contact the guide in the operation of closing the opening/closing member and to move the guide from a position of the guide in the opened state of the opening/closing member toward a position of the guide in the closed state of the opening/closing member.

6. The sheet feeding apparatus according to claim 5, wherein the first contact portion is configured to be separated from the guide in the opened state of the opening/closing member.

7. The sheet feeding apparatus according to claim 1, wherein the abutted portion of the guide is configured to be separated from the abutting portion in the closed state of the opening/closing member.

8. The sheet feeding apparatus according to claim 1, wherein the stacking member includes a second contact portion configured to contact the guide and urge the guide toward the abutting portion in the opened state of the opening/closing member, wherein the second contact portion is a projected portion projected toward a sheet feeding direction by the feeding member from a stacking surface of the stacking member on which the sheet is supported, and wherein the guide includes an opening configured to receive the projected portion in the opened state of the opening/closing member.

9. The sheet feeding apparatus according to claim 8, wherein the stacking member is configured to move with respect to the opening/closing member to approach or separate from the guide in interrelation with an opening and closing of the opening/closing member, wherein, in the opened state of the opening/closing member, the projected portion is configured to enter the opening and press the guide toward the abutting portion, and wherein the projected portion is configured to withdraw from the opening in interrelation with the operation of closing the opening/closing member.

10. The sheet feeding apparatus according to claim 9, further comprising:

an arm supported pivotably by the apparatus body;

a groove provided in the opening/closing member and formed along a direction in which the stacking member approaches or separates from the guide;

a shaft provided on either one of the stacking member and the arm and configured to fit slidably in the groove; and a hole provided on the other one of the stacking member and the arm and configured to fit pivotably to the shaft.

11. The sheet feeding apparatus according to claim 1, wherein the stacking member includes a third contact portion configured to contact the guide in an operation of opening the opening/closing member so as to start movement of the guide from a position of the guide in the closed state of the opening/closing member to a position of the guide in the opened state of the opening/closing member.

12. An image forming apparatus comprising:

the sheet feeding apparatus according to claim 1, and an image forming unit configured to form an image on a sheet fed from the sheet feeding apparatus.

* * * * *